US007044819B1

(12) United States Patent
Dulemba

(10) Patent No.: US 7,044,819 B1
(45) Date of Patent: May 16, 2006

(54) SWIM TRAINING DEVICE

(76) Inventor: Nicholas J. Dulemba, 16376 Jackson St., Taylor, MI (US) 48180-5336

( * ) Notice: Subject to any disclaimer, the term of this patent is extended or adjusted under 35 U.S.C. 154(b) by 0 days.

(21) Appl. No.: 10/880,480

(22) Filed: Jul. 1, 2004

(51) Int. Cl.
*A63B 31/10* (2006.01)
*A63B 31/12* (2006.01)

(52) U.S. Cl. ..... 441/58; 441/59; 441/60; 482/55

(58) Field of Classification Search ..... 441/55–64; 434/254; 482/55, 56, 111–113; D21/803–807
See application file for complete search history.

(56) References Cited

U.S. PATENT DOCUMENTS

| | | | | | |
|---|---|---|---|---|---|
| 689,840 | A | | 12/1901 | Jensen | |
| 1,395,914 | A | * | 11/1921 | Grundmann | 441/58 |
| 1,754,704 | A | * | 4/1930 | Wilcox | 441/58 |
| 2,555,969 | A | * | 6/1951 | Holcombe | 441/58 |
| 2,810,138 | A | * | 10/1957 | Cochran | 441/58 |
| 3,328,812 | A | * | 7/1967 | Berthiot | 441/58 |
| 3,529,313 | A | * | 9/1970 | Barney | 441/58 |
| 4,058,863 | A | | 11/1977 | Ferdico | |
| 4,074,904 | A | | 2/1978 | Arcidiacono | |
| 4,548,588 | A | | 10/1985 | Kosuge | |
| 5,002,268 | A | | 3/1991 | Anderson | |
| 5,304,080 | A | * | 4/1994 | Dilger | 441/58 |
| 5,487,710 | A | | 1/1996 | Lavorgna et al. | |
| 5,820,530 | A | | 10/1998 | Kallassy | |
| 6,183,396 | B1 | * | 2/2001 | Reynier | 482/8 |

* cited by examiner

*Primary Examiner*—Ajay Vasudeva
(74) *Attorney, Agent, or Firm*—Donald R. Schoonover

(57) ABSTRACT

A device can be attached to either the legs or to the arms of a swimmer and produces resistance to swimming whereby the swimmer increases muscle strength and/or technique using the device. There are several forms of the device which offer different amounts of resistance and the device can be worn on either the swimmer's arm or the swimmer's leg.

2 Claims, 2 Drawing Sheets

Fig. 1
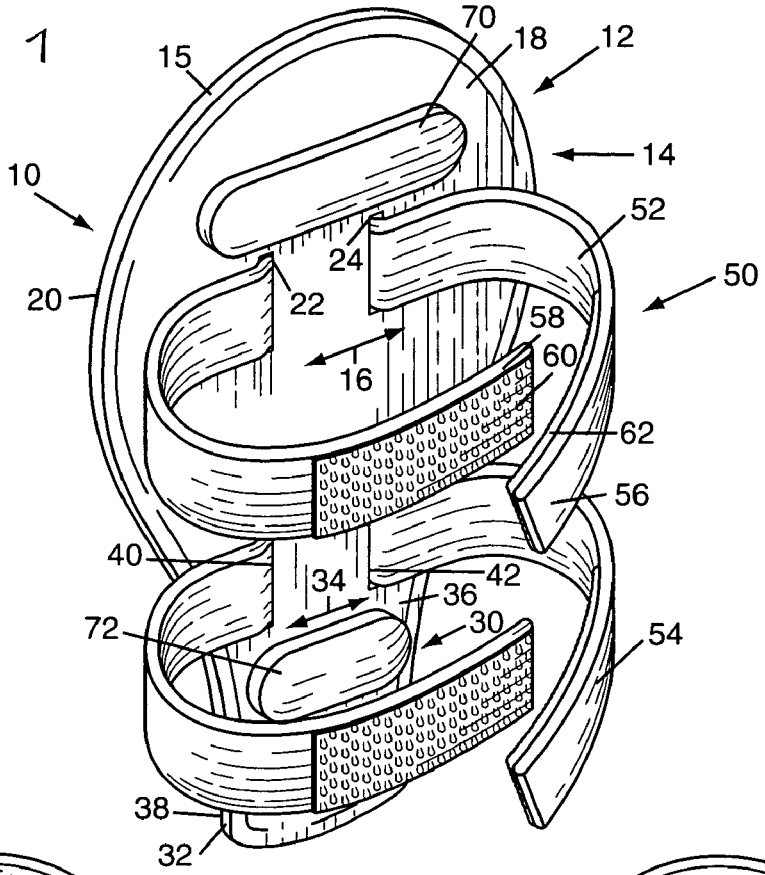
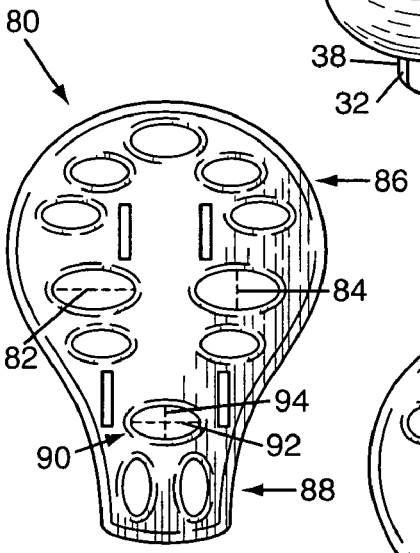
Fig. 2
Fig. 3
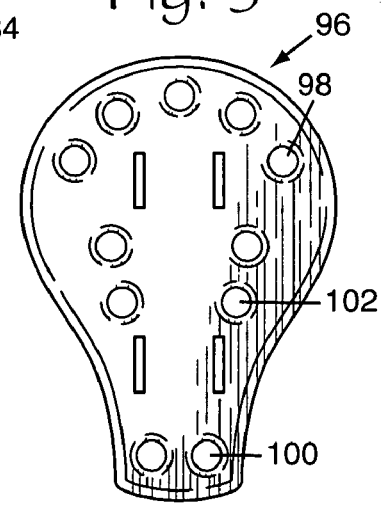
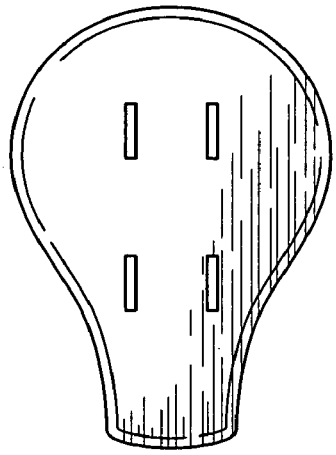
Fig. 4

SWIM TRAINING DEVICE

BACKGROUND OF THE INVENTION

1. Field of the Invention

The present invention relates to the general art of rehabilitation and muscle training, and to the particular fields of training and rehabilitation which use swimming.

2. Discussion of the Related Art

Swimming is one of the most relaxing and beneficial exercises that one can undertake. No undue pressure is placed on the swimmer's limbs or joints as is the case with some other exercises. The water supports the swimmer and thus undue pressure is not applied to the limbs or joints.

For this reason, swimming is often used to condition a person. For this reason, swimming is also sometimes used as part of a rehabilitation program.

As in any exercise, the person becomes better and more proficient as their muscles and cardiovascular system adapt to higher and higher stress levels.

As is the case with any sport or exercise, there is a great deal of equipment that is intended for use by swimmers to improve their skills, their muscle strength or their cardiovascular system. This equipment includes kickboards, hand paddles, drag equipment, weights and the like.

However, in spite of the existence of such equipment, the inventor is not aware of any such equipment that can be easily modified and changed for increasing levels of exercise. That is, as the swimmer becomes stronger, the equipment should place greater stress on his or her muscles in order to continue the improvement. Still further, even if the swimmer has achieved a certain level of muscle strength, that swimmer may not want to practice at the top level of strength for an entire workout or may want to vary the level of resistance for different workouts. The inventor is not aware of any equipment that can achieve these goals.

Therefore, there is a need for a swim training device that can be easily modified to accommodate increased swimmer strength and/or improved swimming technique and which is easily modified to meet the requirements of a specific workout.

If the swim equipment is being used as part of a rehabilitation process, the swimmer may not be able to easily don the equipment. There may be limited mobility or limited dexterity which makes putting the equipment on or taking the equipment off difficult.

Therefore, there is a need for a swim training device that is easy to put on and take off.

Since a swimmer uses both his or her legs and his or her arms, improvement is best facilitated by strengthening both arms and both legs. While there may be equipment that is used to strengthen a swimmer's arms (e.g., hand paddles) and there may be equipment used to strengthen a swimmer's legs (e.g. swim fins), the inventor is not aware of any single piece of equipment that can be used for either or both arm and/or leg strengthening.

Therefore, there is a need for a swim training device that can be used for either strengthening the swimmer's arms or legs.

PRINCIPAL OBJECTS OF THE INVENTION

It is a main object of the present invention to provide a swim training device that can be easily modified to accommodate increased swimmer strength and/or improved swimmer technique.

It is another object of the present invention to provide a swim training device which is easily modified to meet the requirements of a specific workout.

It is another object of the present invention to provide a swim training device that is easy to put on and take off.

It is another object of the present invention to provide a swim training device that can be used for either strengthening the swimmer's arms or legs.

SUMMARY OF THE INVENTION

These, and other, objects are achieved by a swim training device that can be worn on either the forearms or on the legs of the swimmer. One form of the device includes water passage holes defined therethrough, a second form of the device includes smaller water passage holes, and a third form of the device does not have water passage holes. In this manner, the resistance of the device is controlled by the water passage holes. The device is attached to the swimmer using straps which have hook-and-loop fasteners thereon.

Using the swim training device embodying the present invention will permit a swimmer to easily put on or take off the device and will permit a swimmer to adjust the level of resistance to the needs of any particular workout. The device can be used on either the swimmer's arms or the swimmer's legs and is thus quite versatile.

BRIEF DESCRIPTION OF THE DRAWING FIGURES

FIG. 1 is a perspective view of a swim training device embodying the present invention.

FIG. 2 is an elevational view of a first form of the swim training device embodying the present invention.

FIG. 3 is an elevational view of a second form of the swim training device embodying the present invention.

FIG. 4 is an elevational view of a third form of the swim training device embodying the present invention.

DETAILED DESCRIPTION OF THE PREFERRED EMBODIMENT

Figure 5A:
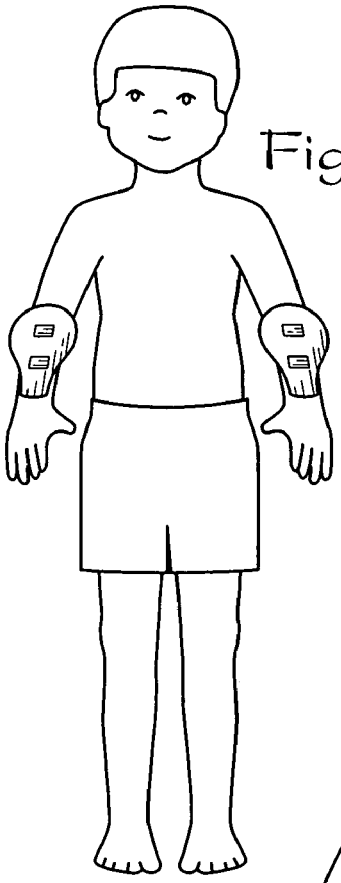
FIG. 5A shows the device embodying the present invention worn on the front of the arm of a swimmer.

Other objects, features and advantages of the invention will become apparent from a consideration of the following detailed description and the accompanying drawings.

Referring to the Figures, it can be understood that the present invention is embodied in a swim training device 10 that can be attached to the swimmer's leg or to the swimmer's forearm. Device 10 comprises a water impermeable body 12 which includes a first circular section 14, which has an outer periphery 15 and a first diameter 16 as measured with respect to the outer periphery 15, a first face 18, a second face 20, and first and second strap-accommodating holes 22 and 24 defined therethrough from the first face 18 to the second face 20. The water-impermeable material can be plastic or the like.

Device 10 further includes a second section 30 which is one-piece with the first section 14 and which includes an outer periphery 32 and a second dimension 34 that is measured with respect to the outer periphery 32 of the second section 30 and which is smaller than the first diameter 16. Second section 30 further includes a first face 36, that is co-planer with first face 18 of the first section 14, and a second face 38, that is co-planar with second face 20 of the first section 14. The second section 30 further includes third and fourth strap-accommodating holes 40 and 42 defined therethrough.

Device 10 further includes a body-attaching system 50 for releasably attaching the device 10 to the swimmer. System 50 includes a first strap 52 mounted on the first section 14 via first and second strap-accommodating holes 22 and 24 and a second strap 54 mounted on the second section 30 via third and fourth strap-accommodating holes 40 and 42. Each of the straps 52, 54 includes two end sections, such as end sections 56 and 58 on strap 52 and hook-and-loop fastener elements, such as hook-and-loop fastener elements 60 and 62, located adjacent to each of the end sections 56, 58.

A first cushion element 70 is mounted on the first face 18 of the first section 14, and a second cushion element 72 is mounted on the first face 36 of the second section 30. The cushion elements 70, 72 engage the skin of the swimmer and are formed of soft material, such as foam or the like, for comfort.

As discussed above, in some cases, the swimmer may want maximum resistance to swimming and in other cases the swimmer may want minimum resistance. Therefore, device 10 includes several forms. A first form is shown in FIGS. 1 and 4 in which virtually the entire surface area of the device is impermeable to water and maximum resistance will be produced.

However, if less swimming resistance is desired, device 10 can accommodate such objective as well. In this case, holes are defined through the device so water may pass through the device thereby reducing the resistance. The holes are sized according to how much resistance is desired.

Therefore, device 10 has the least resistance in FIG. 2 and the device includes a plurality of oval-shaped holes 80 defined through the first section 14 and through the second section 30, each of the holes having a major axis 82 and a minor axis 84. The plurality of holes 80 includes a first set of holes 86 defined through the first section 14 and a second set of holes 88 defined through the second section 30. The second set of holes 88 are oriented with respect to the holes in the first set of holes 86 to have the major axes 82 of the holes of the first set of holes 86 oriented perpendicularly to the major axes 82 of the holes in the second set of holes 88. The major axes 82 of the holes of the first set of holes 86 are parallel with each other and the major axes 82 of the holes of the second set of holes 88 are parallel with each other.

A third oval-shaped hole 90 is located where the first and second sections 14, 30 join each other. Third oval-shaped hole 90 has a major axis 92, oriented parallel to the major axes 82 of the holes in the first set of holes 86, and a minor axis 94.

If still greater resistance is desired, device 10 can be used and will have a plurality of circular holes, such as circular holes 96 shown in FIG. 3, defined in the first and second sections 14, 30. Circular holes 96 include holes 98 defined near the outer periphery 15 of the first section 14, holes 100 defined near the outer periphery 32 of the second section 30 and holes 102 defined in the first section 14 that are spaced apart from the outer periphery 15 of the first section 14.

Figure 5B:
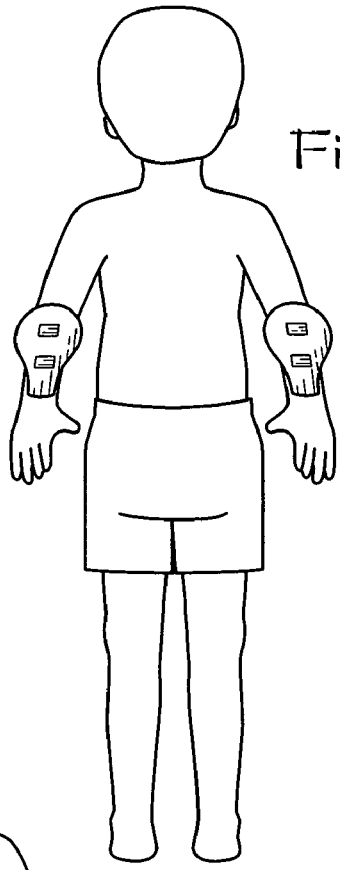
FIG. 5B shows the device embodying the present invention worn on the rear of the arm of the swimmer.
Figure 6A:
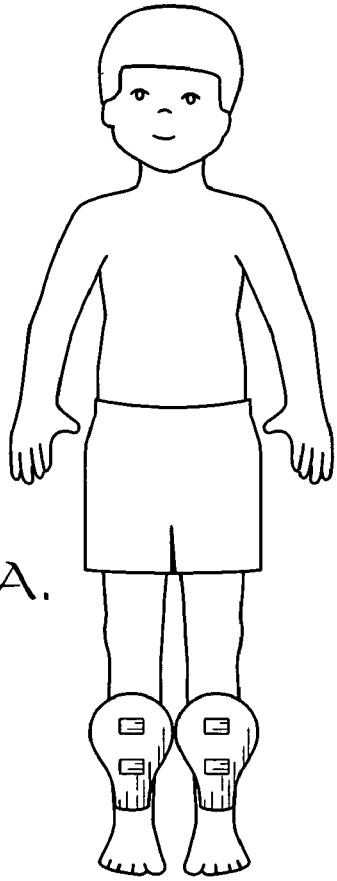
FIG. 6A is a front view showing the device embodying the present invention worn on the leg of the swimmer.
Figure 6B:
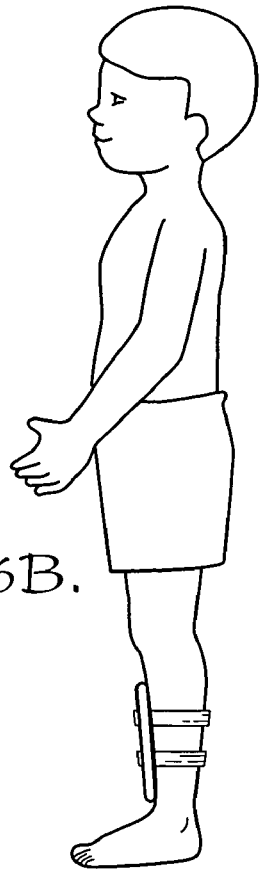
FIG. 6B is a side view showing the device embodying the present invention worn on the leg of the swimmer.

As mentioned above, device 10 can be worn on either the arm or the leg of the swimmer. Device 10 on the arm of the swimmer is shown in FIGS. 5A and 5B with device 10 being worn on the front of the arm in FIG. 5A and on the rear of the arm in FIG. 5B. Device 10 can also be worn on the leg of the swimmer as shown in FIGS. 6A and 6B, with device 10 being worn on the front of the leg in FIGS. 6A and 6B. Device 10 can also be worn on either the side or the rear of the leg as desired.

It is to be understood that while certain forms of the present invention have been illustrated and described herein, it is not to be limited to the specific forms or arrangements of parts described and shown.

The invention claimed is:

1. A swim training device comprising:

a) a water impermeable body which includes (1) a first circular section having an outer periphery and a first diameter measured with respect to the outer periphery of the first section, a first face, a second face and first and second strap-accommodating holes defined therethrough from the first face to the second face, and (2) a second section which is one-piece with the first section and which includes an outer periphery and a second dimension that measured with respect to the outer periphery of the second section and which is smaller than the first diameter, a first face that is co-planer with the first face of the first section, a second face that is co-planar with the second face of the first section, and third and fourth strap-accommodating holes defined therethrough;

b) a body-attaching system which includes a first strap mounted on the first section via the first and second strap-accommodating holes in the first section and a second strap mounted on the second section via the third and fourth strap-accommodating holes, each of the straps including two end sections and hook-and-loop fastener elements located adjacent to each of the end sections;

c) a first cushion element mounted on the first face of the first section;

d) a second cushion element mounted on the first face of the second section; and e) a plurality of oval-shaped holes defined through the first section and through the second section, each of the holes having a major axis and a minor axis, the plurality of holes including a first set of holes defined through the first section and a second set of holes defined through the second section, with the holes in the second set of holes being oriented with respect to the first set of holes to have the major axes of the holes of the first set of holes oriented perpendicularly to the major axes of the holes in the second set of holes, the major axes of the holes of the first set of holes being parallel with each other, and the major axes of the holes of the second set of holes being parallel with each other.

2. The swim training device as described in claim 1 further including a third oval-shaped hole located where the first and second sections join each other, the third oval-shaped hole having a major axis oriented parallel to the major axes of the holes in the first set of holes.

* * * * *